US012121194B2

(12) United States Patent
Fitzgibbons

(10) Patent No.: US 12,121,194 B2
(45) Date of Patent: Oct. 22, 2024

(54) CLEANING GLOVE

(71) Applicant: William Fitzgibbons, Orangeburg, NY (US)

(72) Inventor: William Fitzgibbons, Orangeburg, NY (US)

( * ) Notice: Subject to any disclaimer, the term of this patent is extended or adjusted under 35 U.S.C. 154(b) by 35 days.

(21) Appl. No.: 17/987,972

(22) Filed: Nov. 16, 2022

(65) Prior Publication Data

US 2023/0157513 A1 May 25, 2023

Related U.S. Application Data

(60) Provisional application No. 63/283,237, filed on Nov. 25, 2021.

(51) Int. Cl.
*A47L 13/18* (2006.01)

(52) U.S. Cl.
CPC ..... *A47L 13/18* (2013.01)

(58) Field of Classification Search
CPC .... A47L 13/18; A47L 13/19; A41D 19/01552
See application file for complete search history.

(56) References Cited

U.S. PATENT DOCUMENTS

RE25,675 E * 11/1964 Bonnett ..... A47L 13/18 428/102
3,885,249 A * 5/1975 De Brabander ..... A47L 13/18 2/917
4,621,388 A * 11/1986 Ortolivo ..... A47L 13/19 451/523
4,959,881 A * 10/1990 Murray ..... A47L 13/18 294/1.3
5,956,770 A * 9/1999 Dennis ..... A47L 13/18 2/160
6,018,837 A 2/2000 Andreu
6,098,234 A * 8/2000 Jackson, Jr. ..... A47K 7/02 15/118
6,604,244 B1 * 8/2003 Leach ..... B24D 15/045 2/160

(Continued)

FOREIGN PATENT DOCUMENTS

GB 2368776 A * 5/2002 ..... A41D 19/01594

OTHER PUBLICATIONS

Cleaning Sponge Gloves; amazon.com.

*Primary Examiner* — Alissa L Hoey
(74) *Attorney, Agent, or Firm* — Michael E. Zall

(57) ABSTRACT

A cleaning glove comprising a palm member that has a front surface arranged to receive a first mounting surface and a back surface. The cleaning glove has a first cleaning element. Moreover, the cleaning glove comprises multiple finger members connected to the palm member. Each finger member comprises an inner surface and an outer surface. The outer surface comprises a front section arranged to receive a second mounting surface and a back section arranged to receive a third mounting surface. The cleaning glove also comprises at least one second cleaning element arranged to detachably couple with the second mounting surface and at least one third cleaning element arranged to detachably couple with the third mounting surface. Further, the first cleaning element, the second cleaning element, and the third cleaning element are each selected from a plurality of cleaning pads.

3 Claims, 5 Drawing Sheets

(56) References Cited

U.S. PATENT DOCUMENTS 7,823,245 B2 * 11/2010 Firouzman ..... A47L 13/18 15/118
7,874,020 B1 * 1/2011 Franklin ..... A47L 13/18 2/160
8,370,966 B2 * 2/2013 Hendon ..... A41D 19/01547 2/160
9,241,518 B2 * 1/2016 Patkov ..... A41D 19/01547
9,380,820 B1 * 7/2016 Griego ..... A63B 21/00
9,527,190 B2 * 12/2016 Woody ..... A41D 19/0024
9,635,992 B2 * 5/2017 Redd ..... A47L 13/18
10,028,640 B2 * 7/2018 McGrath ..... A41D 19/0006
10,117,558 B1 * 11/2018 Restrepo ..... A41D 19/0024
10,549,404 B1 * 2/2020 Norton ..... A41D 19/01594
11,129,425 B1 * 9/2021 Sulaiman ..... A41D 19/0006
11,185,197 B2 * 11/2021 Mendez ..... A47L 13/16
11,406,174 B2 * 8/2022 Brown ..... A41D 19/0058
11,904,063 B2 * 2/2024 Greene ..... B08B 1/143
2005/0060786 A1 * 3/2005 Ran ..... A41D 19/01594 2/161.6
2005/0111897 A1 5/2005 Presniakov
2005/0229284 A1 * 10/2005 Gaetz ..... A41D 19/01594 2/159
2006/0272116 A1 12/2006 Thompson
2007/0061986 A1 * 3/2007 Huntington ..... A47L 13/18 15/227
2007/0277288 A1 * 12/2007 Sing ..... A46B 5/04 2/159
2008/0016601 A1 * 1/2008 McCrorey ..... A41D 19/0051 2/159
2008/0227055 A1 * 9/2008 Seidman ..... A46B 9/005 2/160
2008/0301852 A1 * 12/2008 Suran ..... A47L 17/04 2/161.8
2012/0311804 A1 * 12/2012 Leis ..... A47L 13/18 15/227
2017/0296031 A1 * 10/2017 Brown ..... A47L 17/00
2018/0296058 A1 * 10/2018 Firouzman ..... A47L 13/18
2018/0360142 A1 * 12/2018 Barton ..... A41D 19/0024
2022/0132955 A1 * 5/2022 Friend ..... A41D 19/01594 2/160

* cited by examiner

CLEANING GLOVE

RELATED APPLICATION

This application claims the benefit of U.S. Provisional Application No. 63/283,237 filed on Nov. 25, 2021 the entire disclosure of which is incorporated herein by reference.

FIELD OF THE INVENTION

The present invention generally relates to cleaning equipment and more specifically, to a cleaning glove. The present invention also relates to a method for cleaning an article using the cleaning glove.

BACKGROUND

The background description includes information that may be useful in understanding the present invention. It is not an admission that any of the information provided herein is prior art or relevant to the presently claimed invention, or that any publication specifically or implicitly referenced is prior art.

Generally, maintaining cleanliness and hygiene within any facility, such as a home, office, gym and the like, is of utmost importance. It will be appreciated that maintaining hygiene not only protects its inhabitants from potential exposure to elements that may threaten their wellbeing, such as microorganisms including virus, bacteria, fungi and the like, but also, maintaining cleanliness improves an overall quality of living for the inhabitants by making the facility aesthetically appealing.

U.S. Pat. No. 6,018,837 to Andreu; U.S. Patent Publication 2005/0111897 A1 to Presniakov; and U.S. Patent Publication 2006/0272116A1 to Thompson disclose various gloves used for cleaning and scouring and methods for cleaning various articles, e.g., dishes, pots, pans. Additionally, similar gloves are available commercially in online marketplaces as Cleaning Sponge Gloves, for example, from Amazon.com Glove: https://www.amazon.com/dp/B07F1JZK81.

However, ensuring that various surfaces within the facility are clean and hygienic, especially within a large public facility that is frequented by various people (such as a gym, an office building, a cafeteria and the like), can be a monumental task. For instance, cleaning a cafeteria may not only entail cleaning various surfaces within the facility but also entail dusting all furniture, washing dishes that may have been used to prepare or serve food and so forth. Consequently, a person responsible for cleaning such a facility may be required to procure various equipment, including but not limited to, surface cleaners, floor cleaners, sponges, scrub pads, mops, brushes, dusters and so forth and be required to manage the procured equipment to ensure everything is at hand when needed before they even begin cleaning the facility.

It will be appreciated that such management of the equipment, for example, by switching from one type of equipment to wash utensils within the facility, before reaching for another type of equipment to clean a sink that contained the utensils to be washed, can be cumbersome. Therefore, there is a need for systems and methods that can offer convenience when cleaning different types of surfaces at a time.

SUMMARY OF THE INVENTION

The present invention generally relates to cleaning equipment and more specifically, to a cleaning glove. The present invention also relates to a method for cleaning an articles that require cleaning using the cleaning glove.

An embodiment of the present invention may include a cleaning glove including a palm member arranged to be received along a palm of a wearer. The palm member may include a front surface arranged to receive a first mounting surface and a back surface arranged to contact the palm of the wearer.

A first cleaning element is arranged to detachably couple with the first mounting surface. The first cleaning element may include a first mountable surface arranged to mate with the first mounting surface. The glove may also include multiple finger members connected to the palm member; each finger member arranged to receive a finger of the wearer.

Each finger member may include an inner surface arranged to contact the received finger of the wearer and an outer surface. The outer surface may include a front section arranged towards the palm.

The front section of the finger member may be arranged to receive a second mounting surface on the outer surface and may also include a back section arranged to receive a third mounting surface. The glove may also include at least one second cleaning element arranged to detachably couple with the second mounting surface on the finger member.

Each of the at least one second cleaning elements may include a second mountable surface arranged to mate with the second mounting surface. Embodiments may also include at least one third cleaning element arranged to detachably couple with the third mounting surface. In some embodiments, the each of the at least one third cleaning element may include a third mountable surface arranged to mate with the third mounting surface. Preferably, the first cleaning element, the second cleaning element, and the third cleaning element may be each selected from a plurality of cleaning pads.

The plurality of cleaning pads may, for example, include an absorbent sponge pad, a metal sponge pad, an abrasive pad, a bristle pad, and a steel wool pad. In some embodiments of the invention, the cleaning glove may include a thumb member connected to the palm member and arranged to receive a thumb of the wearer. The thumb member may include an internal surface arranged to contact the thumb and an external surface. The external surface of the thumb member may also include a fore side section arranged towards the palm, the fore side section may be arranged to receive a fourth mounting surface on the external surface.

The cleaning glove of this invention may also include a rear side section arranged opposite the palm member, the rear side section may be arranged to receive a fifth mounting surface. Embodiments may also include a fourth cleaning element arranged to detachably couple with the fourth mounting surface, the fourth cleaning element may include a fourth mountable surface arranged to mate with the fourth mounting surface. Embodiments may also include a fifth cleaning element arranged to detachably couple with the fifth mounting surface, the fifth cleaning element may include a fifth mountable surface arranged to mate with the fifth mounting surface.

In some embodiments, the fourth cleaning element may include a fourth gripper to enable detachment of the fourth cleaning element from the fourth mounting surface and the fifth cleaning element may include a fifth gripper to enable detachment of the fifth cleaning element from the fifth mounting surface.

The cleaning glove of this invention may also include a back hand member arranged to connect with the each of the finger member at the back section. The back hand member may include a frontal surface arranged to receive a sixth mounting surface. A hind surface may also be included arranged to contact a dorsal side of a hand of the wearer. Embodiments may also include a sixth cleaning element arranged to detachably couple with the sixth mounting surface, the sixth cleaning element may include a sixth mountable surface arranged to mate with the sixth mounting surface.

The sixth cleaning element may include a sixth gripper to enable detachment of the sixth cleaning element from the sixth mounting surface. Embodiments may also include each of the first cleaning element, the second cleaning element, the third cleaning element, the fourth cleaning element, the fifth cleaning element and the sixth cleaning element may be selected to be same as each other.

Embodiments may also include at least two of the first cleaning element, the second cleaning element, the third cleaning element, the fourth cleaning element, the fifth cleaning element and the sixth cleaning element may be selected to be same as each other. In some embodiments, the first cleaning element may include a first gripper to enable detachment of the first cleaning element from the first mounting surface. In some embodiments, the second cleaning element may include a second gripper to enable detachment of the second cleaning element from the second mounting surface. In some embodiments, the third cleaning element may include a third gripper to enable detachment of the third cleaning element from the third mounting surface.

Embodiments may also include two or more of the multiple finger members that are abricated integrally to receive multiple fingers of the wearer. Embodiments may also include a method for cleaning an article using the cleaning glove, the method including providing the cleaning glove to be worn by the wearer. Embodiments may also include detachably couple the first cleaning element with the first mounting surface. Embodiments may also include detachably couple the second cleaning element with the second mounting surface. Embodiments may also include detachably couple the third cleaning element with the third mounting surface. Embodiments may also include employing the cleaning glove to clean the article.

BRIEF DESCRIPTION OF THE DRAWINGS

The features and advantages of the present disclosure are more clearly understood from the following description taken in conjunction with the accompanying drawings in which.

DETAILED DESCRIPTION

Figure 1:
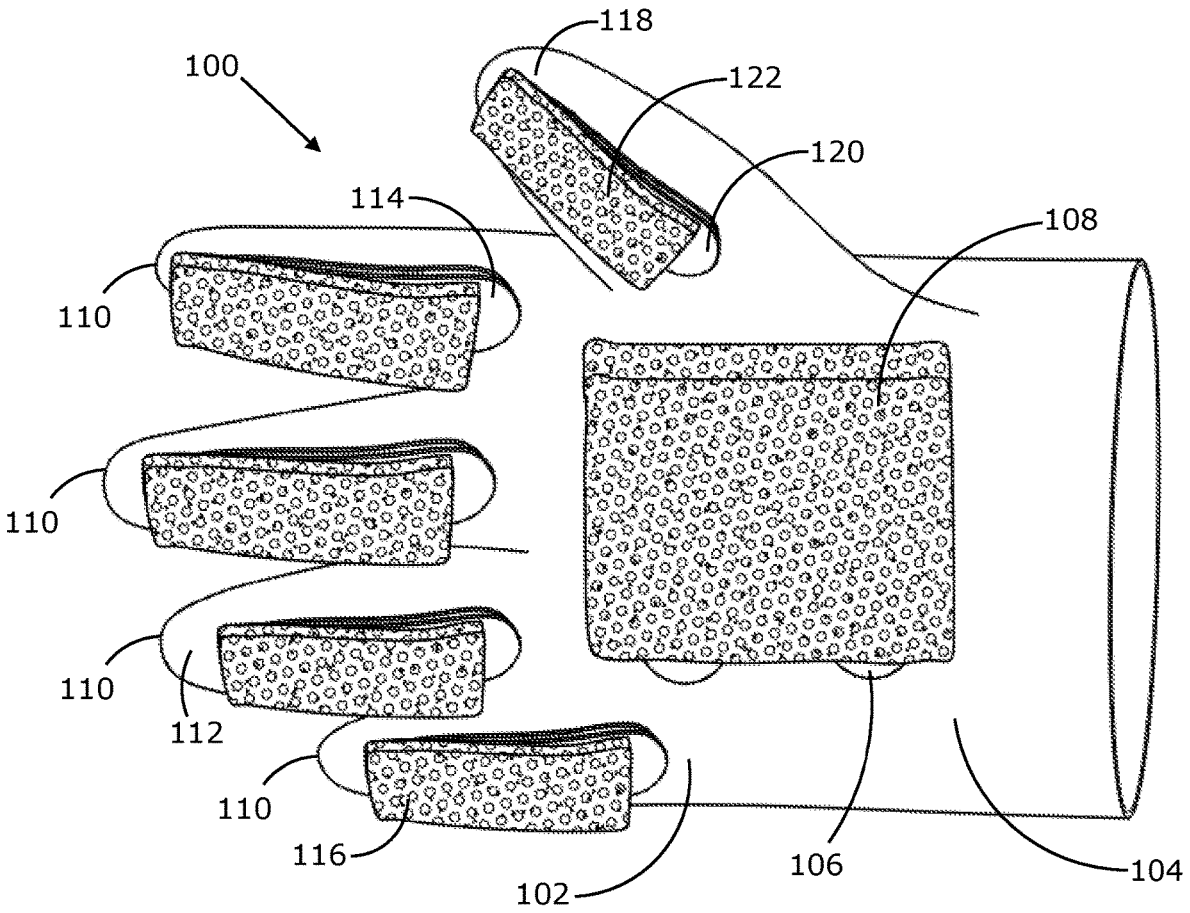
FIG. 1 illustrates a front view of a cleaning glove, in accordance with an embodiment of the present disclosure.

In the following detailed description of the invention, reference is made to the accompanying drawings that form a part hereof, and in which is shown, by way of illustration, specific embodiments in which the invention may be practiced. In the drawings, like numerals describe substantially similar components throughout the several views. These embodiments are described in sufficient detail to enable those skilled in the art to practice the invention. Other embodiments may be utilized, and structural changes may be made without departing from the scope of the present invention. The following detailed description is, therefore, not to be taken in a limiting sense, and the scope of the present invention is defined only by the appended claims and equivalents thereof.

The present invention generally relates to cleaning equipment and more specifically, to a cleaning glove 100. The present invention also relates to a method for cleaning an article using the cleaning glove.

Referring to FIG. 1, there is shown a front view of a cleaning glove 100, in accordance with an embodiment of the present disclosure. The cleaning glove 100 can be employed for cleaning surfaces, for example, plates, cups, trays, bottles, pots, pans, fryers, and the like. The cleaning glove of this invention may be used within an indoor facility, for example, a school cafeteria and the various surfaces to be cleaned, e.g., tables and chairs used by students and staff members to sit on and place their utensils and trays. Further, the various surfaces can comprise a countertop where orders for food items are received and the food items are served. The surfaces to be cleaned can comprise indoor surfaces of electrical equipment such as refrigerators, microwave ovens, electric stoves and the like that are employed for preparation of the food items for consumption. Additionally, the surfaces can comprise inner surfaces of one or more sinks that are used by the students and staff members to wash their hands, face and the like or surfaces within lavatories that are used by the students and staff members to relieve themselves prior to or after consumption of food items. Also, the surfaces can comprise a floor of the cafeteria that may be treaded on by the students and staff members while wearing dirty footwear, doors and windows touched by the students and staff members with unwashed hands and suchlike.

It will be appreciated by a person ordinarily skilled in the art that in the example above, personnel responsible for cleaning some or all of the aforementioned surfaces will be required to acquire multiple different equipment such as various scrub pads, dusters, brushes and so on for cleaning the surfaces in addition to chemical products such as floor cleaners, toilet cleaners, bleach, detergents, water and the like to assist them in cleaning the surfaces. Further, the personnel will be required to carry the multiple different equipment and chemical products, ensuring that the equipment and products are at hand when required. However, carrying all such equipment and chemical products at once may be cumbersome for the personnel, which may cause the personnel to store the equipment and chemical products away from themselves. Consequently, a task of cleaning the various surfaces within the facility becomes tiresome for the personnel, requiring them to exert a higher amount of effort over a longer duration to accomplish the task.

The cleaning glove 100 enables a wearer of the cleaning glove 100 to efficiently and effectively clean various surfaces in the indoor facility, partially or substantially alleviating one or more issues associated with acquisition and management of conventional cleaning equipment and chemical products.

The cleaning glove 100 of this invention comprises a palm member 102 arranged to be received along a palm of a wearer. The palm member 102 forms the biggest portion of the cleaning glove 100. The palm member 102 is arranged to enclose a palm of the wearer. Further, the palm member 102 comprises a back surface and a front surface 104, which receives a first mounting surface 106. The front surface 104 of the palm member 102 corresponds to a surface of the palm member 102 that faces away from the palm of the wearer when the cleaning glove 100 is worn by the wearer. Further, the front surface 104 is arranged to receive the first mounting surface 106. The first mounting surface 106 can be implemented as an attachment that is permanently affixed to the front surface 104 of the palm member 102. For example, the first mounting surface 106 is a hook sheet of Velcro® that is sewn (or stuck using water-insoluble adhesive) on to the front surface 104 of the palm member 102. Moreover, the back surface of the palm member 102 is a surface of the palm member 102 that remains in contact with the palm of the wearer as long as the cleaning glove 100 is worn by the wearer.

Optionally, the palm member 102 can be fabricated using a waterproof (such as water-resistant or water-repellent) material (e.g., rubber, polyethylene etc.). It will be appreciated that the wearer will be required to touch unhygienic liquids when cleaning surfaces, such as, spilt liquid on floors, vomit, standing water and the like. Consequently, the palm member 102 is fabricated using the waterproof fabric to prevent contact of such unhygienic liquids with skin of the wearer. In one embodiment, the waterproof (such as water-resistant or water-repellent) fabric comprises plastic, nylon, polyester, laminated cotton and the like.

Optionally, the palm member 102 is fabricated using a sweat-proof fabric. Alternatively, the back surface of the palm member 102 can be coated with or comprises multiple patches of sweat absorbing material. It will be appreciated that the wearer will be required to wear the cleaning glove 100 for extended durations when they clean various surfaces within a facility. Consequently, sweat exuded from their skin might collect within the cleaning glove 100, causing the wearer discomfort when the cleaning glove 100 is worn for extended periods.

Figure 2:
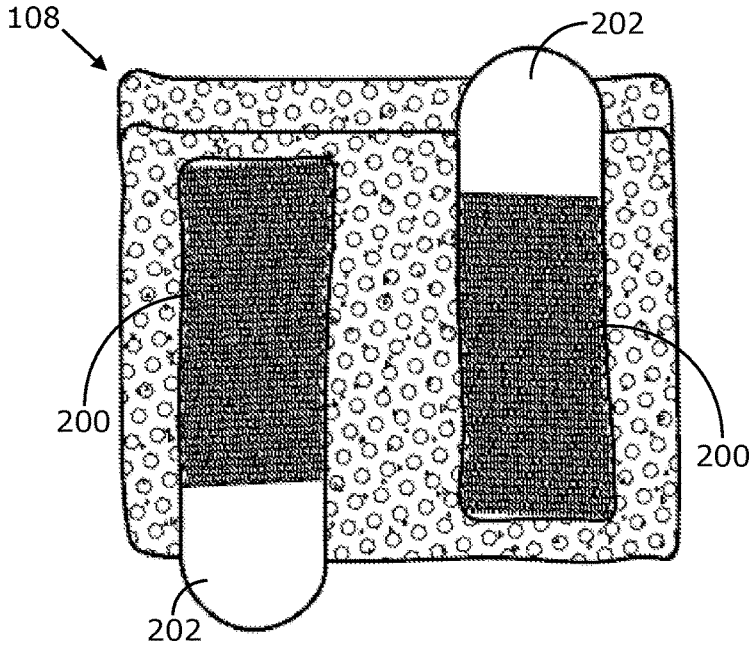
FIG. 2 illustrates a rear view of the first cleaning element 108, in accordance with an embodiment of the present disclosure.

Referring to FIGS. 1 and 2, the cleaning glove 100 comprises a first cleaning element 108 arranged to detachably couple with the first mounting surface 106. The first cleaning element 108 may consist of a variety of cleaning surfaces used to clean surfaces using the cleaning glove 100. For example, when the cleaning glove 100 is employed to clean various surfaces within a toilet, the first cleaning element 108 can be a sponge pad or a bristle brush pad. The first cleaning element 108 comprises a first mountable surface 200 (shown in FIG. 2) arranged to mate with the first mounting surface 106. The first mountable surface 200 is permanently affixed to a surface of the first cleaning element 108 that is not employed for cleaning surfaces. In one example, the first mountable surface 200 is implemented as a loop sheet of Velcro® using a water-insoluble adhesive. Consequently, the first cleaning element 108 can be detachably coupled with the first mounting surface 106 of the palm member 102 through mating of the first mountable surface 200 of the first cleaning element 108 with the first mounting surface 106 of the palm member 102. For example, when the first mounting surface 106 of the palm member 102 is implemented as a hook sheet of Velcro® and the first mountable surface 200 (depicted in FIG. 2) of the first cleaning element 108 is implemented as a loop sheet of Velcro®, the first cleaning element 108 can be arranged and pressed against the palm member 102 for detachable coupling of the first cleaning element 108 with the palm member 102. In such an example, when the first cleaning element 108 is required to be removed from the palm member 102, such as, for cleaning, replacement or disposal of the first cleaning element 108, the first cleaning element 108 can be pulled apart from the palm member 102 for detachment of the first cleaning element 108 from the palm member 102.

Referring to FIG. 1, the cleaning glove 100 comprises multiple finger members 110 connected to the palm member 102, each finger member is arranged to receive a finger of the wearer. The multiple finger members 110 can be connected to the palm 102 through permanent attachment of the multiple finger members 110 with the palm member 102, such as, through sewing, using an industrial strength adhesive, and so on. Alternatively, the multiple finger members 110 can be integrally formed with the palm member 102. Each finger member 110 can be fabricated using a waterproof (such as water-resistant or water-repellent) and/or sweat-proof fabric, as with the palm member 102. However, it will be appreciated that during cleaning of surfaces, the multiple finger members 110 will likely experience a higher amount of friction, such as, due to rubbing of the multiple finger members 110 against rough surfaces. Thus, the multiple finger members 110 can be fabricated using a fabric having higher resistance to wear and tear (such as a commercially available heavy-duty fabric) than the fabric employed for the palm member 102.

Each finger member comprises an outer surface 112 and an inner surface arranged to contact the finger of the wearer. It will be appreciated that when the cleaning glove 100 is worn by the wearer, one surface (such as the inner surface) of each finger member will contact a skin of the wearer and a surface outside (such as the outer surface 112) will be exposed to an outside environment. In one example, the multiple finger members 110 can be fabricated to be multi-layered. In such an example, inner surface can be fabricated using a skin-friendly fabric and the outer surface can be fabricated using a fabric having higher resistance to wear and tear than the fabric employed for the inner surface.

Moreover, the outer surface 112 of each finger member of the multiple finger members 110 comprises a back section and a front section, which can be arranged towards the palm. The front section of each finger member corresponds to a side of the finger member that is arranged to be coplanar with the palm of the wearer when the cleaning glove 100 is worn by the wearer. The front section is arranged to receive a second mounting surface 114 on the outer surface 112. Similarly, to the first mounting surface 106 of the palm member 102, the second mounting surface 114 can also be implemented as an attachment that is permanently affixed to the front section of each finger member. For example, the second mounting surface 114 can be implemented using magnets that are stuck using a water-insoluble adhesive on to the front section of the corresponding finger member.

The back section of the finger member is arranged to receive a third mounting surface. The back section of each finger member of the multiple finger members 110 corresponds to a surface of the finger member that is received to be coplanar with fingernails of the wearer when the cleaning glove 100 is worn by the wearer. Moreover, similarly to the second mounting surface 114 received on the front section of each finger member, the third mounting surface 402 (shown in FIG. 4) can also be implemented as an attachment that is permanently affixed to the back section of each finger member. For example, the third mounting surface 402 can be implemented using snap fasteners that are stuck using a water-insoluble adhesive on to the back section of the corresponding finger member.

The cleaning glove 100 also comprises at least one second cleaning element 116 arranged to detachably couple with the second mounting surface 114, wherein each of the at least one second cleaning elements 116 comprises a second mountable surface (not shown) arranged to mate with the second mounting surface 114. Each finger member 110 comprises a corresponding second cleaning element 116. The second cleaning element 116 can be implemented based on usage of the cleaning glove 100. For example, when the cleaning glove 100 is primarily used for cleaning surfaces within a kitchen, such as, scrubbing used utensils and cleaning countertops within the kitchen, the second cleaning element 116 can be implemented using scrub pads or steel wool pads. Further, each of the second cleaning elements 116 comprises the second mountable surface that enables detachable coupling of the second cleaning element 116 with the second mounting surface 114.

In the aforementioned example, wherein the second mounting surface 114 is implemented using magnets that are stuck using the water-insoluble adhesive on to the front section of the corresponding finger member, the second mountable surface can be implemented using magnets that are stuck on to the second cleaning element 116.

Moreover, the cleaning glove 100 comprises at least one third cleaning element 400 (shown in FIG. 4) arranged to detachably couple with the third mounting surface (shown in FIG. 4), wherein each of the at least one third cleaning element 400 comprises a third mountable surface (not shown) arranged to mate with the third mounting surface. Each finger member 110 comprises a third cleaning element 400 that can be detachably coupled to the back section each finger member. Further, the third cleaning element 400 can be implemented based on usage of the cleaning glove 100.

For example, when the cleaning glove 100 is primarily used for cleaning surfaces that are prone to receiving scratches, such as, television displays, glass and the like, the third cleaning element 400 can be implemented using soft sponge pads or lint-free fabric. Further, the third mountable surface of each of the at least one third cleaning element 400 enables to mate the third cleaning element 400 with the third mounting surface. In the aforementioned example, wherein the third mounting surface is implemented using snap fasteners, the third mountable surface can also be implemented using snap fasteners that are capable of engaging with the snap fasteners of the third mounting surface. In an exemplary scenario, if wearer needs to clean bottle from inside, absorbent sponge pad based second cleaning element 116 and third cleaning element 400 can be attached to front section and back section, respectively, of any finger member 110. Then wearer/user can insert finger within bottle to enable simultaneous cleaning operation within bottle, through the absorbent sponge pad presence on both side of finger member 110. At the same time, if glove 100 is mounted with additional second cleaning element 116 onto the finger member 110 (other than which present into the bottle), may enable concurrent cleaning from inside and outside.

In one embodiment, two or more of the multiple finger members 110 are fabricated integrally to receive multiple fingers of the wearer. For example, four finger members of the multiple finger members 110 are fabricated integrally to receive four fingers of the wearer. It will be appreciated that in such an example, the cleaning glove 100 resembles a mitt that can be employed for cleaning surfaces. Consequently, the at least one second cleaning element 116 and the at least one third cleaning element 400 can be fabricated to correspond to a combined length and width of the four finger members 110 that are fabricated integrally with each other.

The first cleaning element 108, the second cleaning element 116, and the third cleaning element 400 are each selected from a plurality of cleaning pads. The plurality of cleaning pads can comprise a selection adapted for a specific cleaning task, such as, based on one or more surfaces to be cleaned using the cleaning glove 100.

In an embodiment, the plurality of cleaning pads comprises an absorbent sponge pad, a metal sponge, an abrasive pad, a cleaning pad, scouring hand pad, a bristle pad, a steel wool pad. During usage, the wearer of the cleaning glove 100 wears the cleaning glove 100 and detachably attaches the first cleaning element 108, the at least one second cleaning element 116 and the at least one third cleaning element 400 to the first mounting surface 106, the second mounting surface 114 and the third mounting surface. Subsequently, the wearer uses their hand wearing the cleaning glove 100 as they would use on equipment for cleaning surfaces.

For example, when the wearer is required to wash a vehicle, such as a motorbike or a car, the wearer detachably couples an absorbent sponge pad to the palm member 102, cotton fabric pads to the front sections of the multiple finger members 110 and bristle brush pads to the back sections of the multiple finger members 110. Subsequently, the wearer can clean surfaces prone to receiving scratches, such as a windscreen and rear-view mirrors of a car using the absorbent sponge pad (having a cleaning solution soaked into the absorbent sponge pad) and thereafter, wipes the windscreen and/or rear-view mirrors using the cotton pads arranged along the front sections of the multiple finger members 110. Further, if the wearer finds any hard to remove contaminants on a body of the car, such as grime, soil or bird faecal matter, the wearer can scrape them away using the bristle brush pads along the back sections of the multiple finger members 110.

In one embodiment, the first cleaning element 108 comprises a first gripper 202 to enable detachment of the first cleaning element 108 from the first mounting surface 106, the second cleaning element 116 comprises a second gripper (not shown) to enable detachment of the second cleaning element 116 from the second mounting surface 114 and the third cleaning element 400 comprises a third gripper (not shown) to enable detachment of the third cleaning element 400 from the third mounting surface. The first gripper 202, the second gripper and the third gripper can be implemented as fabric holders that extend beyond operating surfaces (such as, surfaces used to clean various surfaces) of the first cleaning element 108, the second cleaning element 116 and the third cleaning element 400. Consequently, pressure can be applied to the first gripper 202, the second gripper and the third gripper, such as by pulling them, to cause detachment of the first cleaning element 108, the second cleaning element 116 and the third cleaning element 400 from the first mounting surface 106, the second mounting surface 114 and the third mounting surface, respectively.

In an embodiment, the cleaning glove 100 comprises a thumb member 118 connected to the palm member 102 and arranged to receive a thumb of the wearer. The thumb member 118 is connected to the palm member 102 at a right side or a left side of the palm member depending on whether the glove is configured to be worn on a right hand or a left hand of the wearer, respectively. The thumb member 118 comprises an external surface and an internal surface arranged to contact the thumb. Similarly, to the multiple finger members 110, the thumb member 118 comprises the internal surface that contacts the skin of the wearer when the cleaning glove 100 is worn by the wearer.

In such an instance, the external surface is disposed towards an environment. Further, the external surface of the thumb member 118 comprises a fore side section arranged towards the palm, wherein the fore side section is arranged to receive a fourth mounting surface on the external surface and a rear side section arranged opposite the palm, wherein the rear side section is arranged to receive a fifth mounting surface. The fore side section of the thumb member 118 corresponds to a surface of the thumb member 118 that is disposed to be coplanar with the palm of the wearer and the rear side section of the thumb member 118 corresponds to a surface of the thumb member 118 that is disposed to be coplanar with a thumbnail of the wearer. Moreover, the fourth mounting surface 120 is permanently attached to the fore side section of the thumb member 118, such as, through sewing and/or using a permanent water-insoluble adhesive. Similarly, the fifth mounting surface (not shown) is permanently attached to the rear side section of the thumb member 118, such as, through sewing and/or using a permanent water-insoluble adhesive. Moreover, the cleaning glove 100 comprises a fourth cleaning element 122 arranged to detachably couple with the fourth mounting surface 120. The fourth cleaning element 122 can be implemented based on usage of the cleaning glove 100 for cleaning surfaces.

For example, when the cleaning glove 100 is employed for cleaning drainage pipes and other similar equipment having small openings, the fourth cleaning element 122 can be implemented using a bristle brush pad. Further, the fourth cleaning element 122 is implemented by cutting a portion of such a bristle brush pad such that a length and width of the fourth cleaning element 122 corresponds to a length and width of the thumb member 118. Moreover, the fourth cleaning element 122 comprises the fourth mounting surface 120 for receiving the fourth mountable surface (not shown). In an example, the fourth mounting surface 120 is implemented using buckle fasteners. The fourth cleaning element 122 comprises a fourth mountable surface arranged to mate with the fourth mounting surface 120. In the aforementioned example wherein the fourth mounting surface 120 is implemented using buckle fasteners, the fourth mountable surface can be implemented using belts or straps that are configured to engage with the buckle fasteners. Also, the cleaning glove 100 comprises a fifth cleaning element (not shown) arranged to detachably couple with the fifth mounting surface. The fifth cleaning element can be implemented based on usage of the cleaning glove 100 for cleaning surfaces. In one example, the cleaning glove 100 is primarily employed for dusting glass surfaces.

In such an example, the fifth cleaning element can be implemented using a cotton pad capable of removing dust from surfaces. The fifth cleaning element comprises a fifth mountable surface (not shown) arranged to mate with the fifth mounting surface. In an example, the fifth mounting surface is implemented hook fasteners arranged along a surface (such as a fabric surface). In such an example, the fifth mountable surface can be implemented using eye fasteners capable of engaging with the hook fasteners of the fifth mounting surface.

During use, it will be appreciated that the wearer wearing the cleaning glove 100 may also employ their thumb in addition to their palm and fingers, for cleaning surfaces. For example, when cleaning a sink, the wearer wearing the cleaning glove 100 may insert their thumb into a drainage pipe of the sink to thoroughly scrub an inside surface of the drainage pipe. In such an example, the fourth cleaning element 122 and the fifth cleaning element that are detachably coupled to the cleaning glove 100 based on usage of the cleaning glove 100 (such as, for cleaning the sink) will enable the wearer to conveniently clean various surfaces of the sink without having to use other equipment (such as brushes, scrubbing pads and the like).

In one embodiment, the fourth cleaning element 122 comprises a fourth gripper (not shown) to enable detachment of the fourth cleaning element 122 from the fourth mounting surface 120 and the fifth cleaning element comprises a fifth gripper (not shown) to enable detachment of the fifth cleaning element from the fifth mounting surface. In an example, the fourth gripper and the fifth gripper can be implemented as tabs that are attached to ends of the fourth cleaning element 122 and the fifth cleaning element, respectively. The wearer can pull the tabs for removal of the fourth cleaning element 122 and the fifth cleaning element from the cleaning glove 100.

According to an embodiment, the cleaning glove 100 comprises a back hand member 702 (shown in FIG. 7) arranged to connect with the each of the finger members at the back section. The back hand member 702 corresponds to a rear surface of the palm member 102. The back hand member 702 comprises a frontal surface arranged to receive a sixth mounting surface 704 and a hind surface arranged to contact a dorsal side of the hand of the wearer. The hind surface corresponds to a surface of the back hand member 702 that contacts the skin of the wearer when the cleaning glove 100 is worn by the wearer. Further, the frontal surface of the back hand member 702 corresponds to a surface of the wearer that is exposed to an environment outside the dorsal side of the hand of the wearer. The frontal surface of the back hand member 702 comprises the frontal surface that can be implemented using, for example, a smooth plastic sheet. Further, the cleaning glove 100 comprises a sixth cleaning element 706 (shown in FIG. 7) arranged to detachably couple with the sixth mounting surface 704 (shown in FIG. 7), wherein the sixth cleaning element 706 comprises a sixth mountable surface (not shown) arranged to mate with the sixth mounting surface 704. The sixth cleaning element 706 can be implemented based on usage of the cleaning glove 100. For example, when the cleaning glove 100 is primarily employed for cleaning surfaces within a washroom, including tiles, sink, toilet bowl and the like, the sixth cleaning element 706 can be implemented using a scrub pad or a bristle brush pad. Also, the sixth cleaning element 706 comprises the sixth mountable surface. In the aforementioned example wherein the sixth mounting surface 704 is implemented using a plastic sheet, the sixth mountable surface can be implemented using reusable tape (for example, reusable silicone tape).

During use, it will be appreciated that the wearer of the cleaning glove 100 may employ an entirety of their hand for cleaning surfaces. For example, when the wearer cleans a toilet bowl while wearing the cleaning glove 100, they may use their palm, fingers, thumb as well as the dorsal side of their hand for scrubbing the toilet bowl. In such an example, the sixth cleaning element 706 detachably attached to the frontal side (of cleaning glove 100 that may already have attached first cleaning element 108, and multiples of second cleaning elements and third cleaning elements 600 (depicted in FIG. 6) of the hand of the wearer enables the wearer to efficiently and effectively clean such surfaces using a minimum number of strokes of their hand and consequently, reduced overall effort.

In one embodiment, the sixth cleaning element 706 comprises a sixth gripper to enable detachment of the sixth cleaning element 706 from the sixth mounting surface 704. For example, the sixth gripper can be implemented as clamps that can be pulled by the wearer for removal of the sixth cleaning element 706 from the sixth mounting surface 704, such as, for removal, replacement or disposal of the sixth cleaning element 706.

In an embodiment, each of the first cleaning element 108, the second cleaning element 116, the third cleaning element 400, the fourth cleaning element 122, the fifth cleaning element and the sixth cleaning element 706 are selected to be same as each other. It will be appreciated that by selecting the first cleaning element 108, the second cleaning element 116, the third cleaning element 400, the fourth cleaning element 122, the fifth cleaning element and the sixth cleaning element 706 to be the same as each other, an effective surface area associated with a particular type of cleaning element for cleaning surfaces is increased. For example, when the wearer of the cleaning glove 100 intends to clean a body of a car using the cleaning glove, selecting all of the first cleaning element 108, the second cleaning element 116, the third cleaning element 400, the fourth cleaning element 122, the fifth cleaning element and the sixth cleaning element 706 to be an absorbent sponge pad increases an effective surface area associated with the absorbent sponge pad, enabling the wearer to quickly clean the body of the car by exerting minimal effort.

In another embodiment, at least two of the first cleaning element 108, the second cleaning element 116, the third cleaning element 400, the fourth cleaning element 122, the fifth cleaning element and the sixth cleaning element 706 are selected to be same as each other. The wearer of the cleaning glove 100 may be required to clean surfaces having different cleaning requirements. For example, the wearer may be required to clean a kitchen comprising various utensils, a kitchen floor having large dimensions, kitchen countertop and the like. In such an example, the wearer may select the first cleaning element 108, the second cleaning element 116, and the third cleaning element 400 to be abrasive pads, the fourth cleaning element 122 to be a metal sponge and the fifth cleaning element and the sixth cleaning element 706 to be bristle pads. Consequently, the wearer can efficiently clean various surfaces within the kitchen without requiring to acquire and manage different types of cleaning equipment (such as cleaning brushes, pads and the like).

Referring to FIG. 2, there is shown a rear view of the first cleaning element 108, in accordance with an embodiment of the present disclosure. As shown, the first cleaning element 108 comprises a first mountable surface 200 and a first gripper 202 that can be used by wearer to grip during peeling off the attached first cleaning element 108. Thus, first gripper 202 is an area of the first cleaning element 108, which is free from cleaning element such as bristles or sponge.

The glove 100 may have between 6 and 11 attachment areas (1 first mounting surface 106, 3-4 second mounting surface 114, 3-4 third mounting surface, 1 fourth mounting surface 120 and 1 fifth mounting surface), having various cleaning surfaces attached. The purpose of attachment areas enable a wearer to attach and detach different cleaning materials (first cleaning element 108, second cleaning element 116, third cleaning element and fourth cleaning element 122, etc.) to clean the surfaces without disengaging from action. Meaning a sponge can be on one side and scrubber on the other. The wearer can wipe with open palm certain dirty areas and make fist when scrub is needed.

Figure 3:
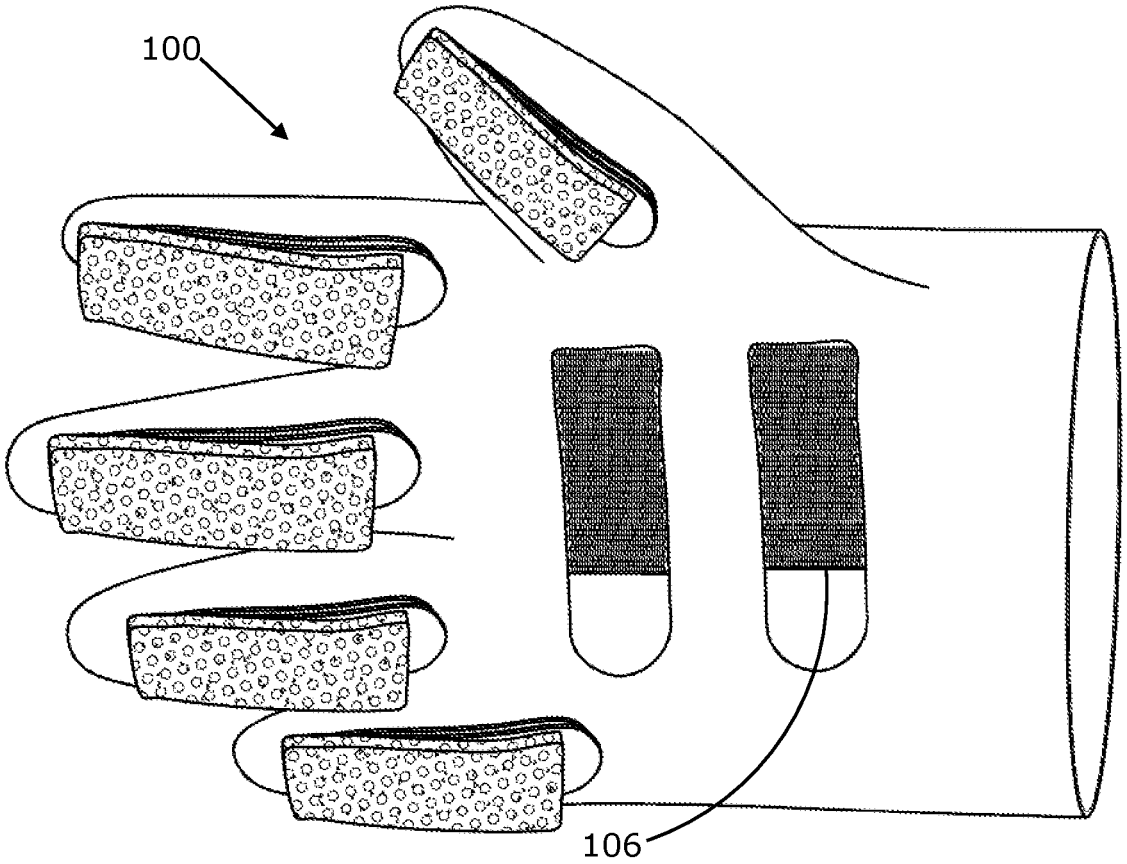
FIG. 3 depicts a front view of the cleaning glove with first mounting surface 106, in accordance with an embodiment of the present disclosure.

Referring to FIG. 3, there is shown a front view of the cleaning glove 100 with first mounting surface 106 (that can be arranged to receive the first cleaning element 108), in accordance with an embodiment of the present disclosure. It would be appreciated that first mounting surface 106 can be of any size, shape and material. The first mounting surface 106 can be attached with palm member 102 by utilizing any mechanism, including but not limited to, adhesive (e.g., two-part epoxy adhesive), sewing. Alternatively, the first mounting surface 106 can be fused with the palm member 102 through heating. The glove 100 material itself can be durable to enable purchase of attachments rather than glove 100 itself.

Figure 4:
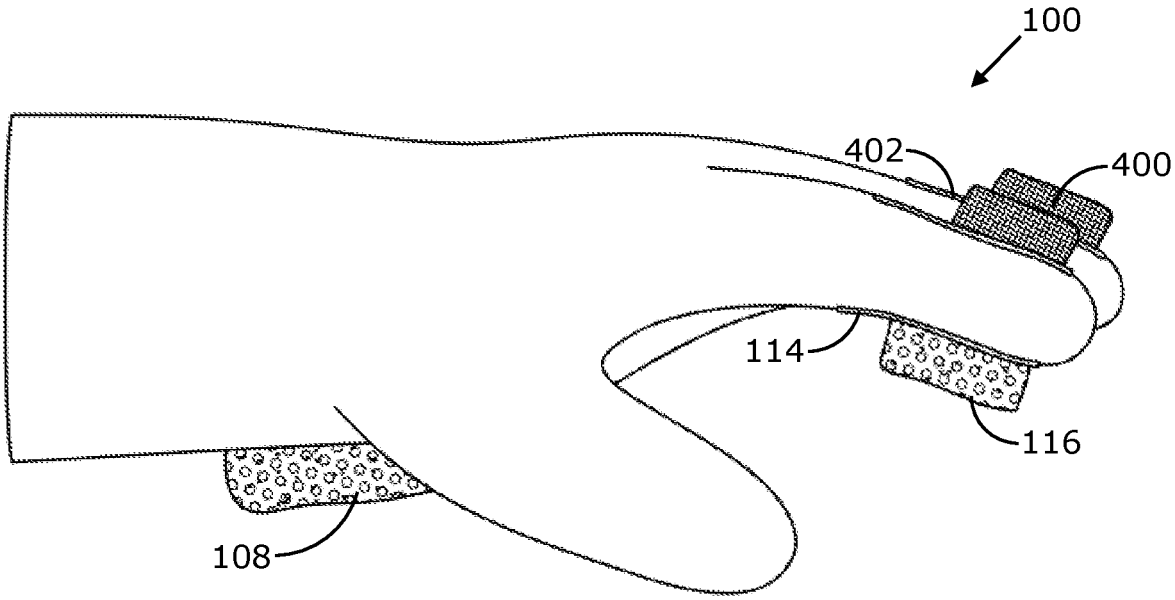
FIG. 4 illustrates a side view of the cleaning glove, in accordance with an embodiment of the present disclosure.

Referring to FIG. 4, there is shown a side view of the cleaning glove 100, in accordance with an embodiment of the present disclosure. As shown, the cleaning glove 100 comprises a third cleaning element 400 detachably coupled to a third mounting surface 402. Side view clearly depicts second mounting surface 114 on the outer surface 112.

The glove 100 reduces inefficiency of constantly grabbing different types of sponges and scrubbing tools while washing many dishes. By incorporating scrubbing and cleaning surfaces into glove 100 itself, the wearer of glove 100 can protect the skin of their hands, and also quickly and easily change tools without interrupting the cleaning.

The cleaning glove 100 can be similar to any rubber or latex cleaning glove, but the glove 100 may have an interlocking material on the surface (a non-specific example of such a material would be one side of Velcro®). Subsequently, integration of one half of interlocking material of the glove 100 allows the wearer to swap different attachments onto the glove 100 while it is being used. Thereby, rapidly switching of what surface they are using for cleaning. For example, the wearer can switch from using soft sponge to an abrasive pad without dropping what they are holding by simply turning the glove over.

Exemplary gloves 100 may include 4 individual scrub pieces—L 1¾ inch×W ¾ inch, attached to glove 100 by 3M interlocking type material for interchangeable function and 1 larger piece for palm member 102/first cleaning element 108 can be 2⅛ inches×2⅛ inches with rather rounded edges. All sponge and scrub material can be ½ inch thick.

Figure 5:
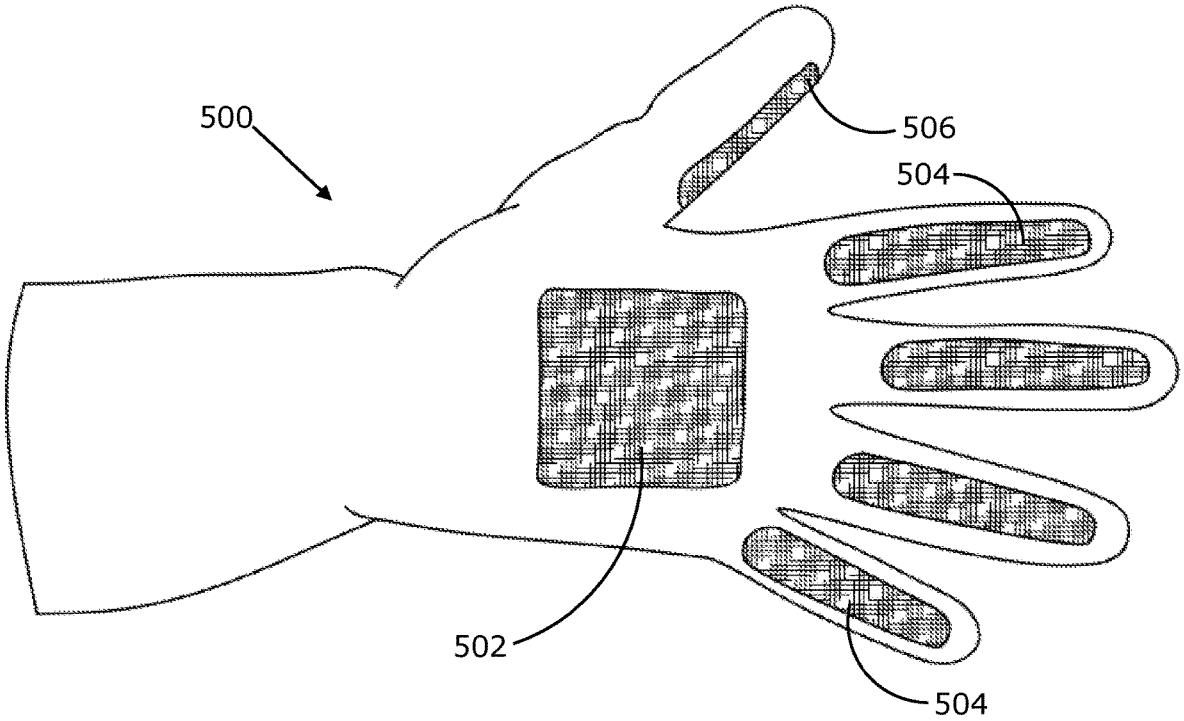
FIG. 5 illustrates a front, palm view of a cleaning glove, in accordance with an embodiment of the present disclosure.

Referring to FIG. 5, there is shown a front view of a cleaning glove 500, in accordance with an embodiment of the present disclosure. The cleaning glove 500 is similar to the cleaning glove 100 shown in FIGS. 1-4. However, a first cleaning element 502, second cleaning elements 504 and a fourth cleaning element 506 of the cleaning glove 500 are implemented as steel wool pads. It will be appreciated that such an implementation of the first cleaning element 502 (same as 108), the second cleaning elements 504 and the fourth cleaning element 506 of the cleaning glove 500 as steel wool pads increases a surface area associated with the steel wool pads for cleaning large surfaces, such as, kitchen walls, floors, external bodies of cars and such like.

Figure 6:
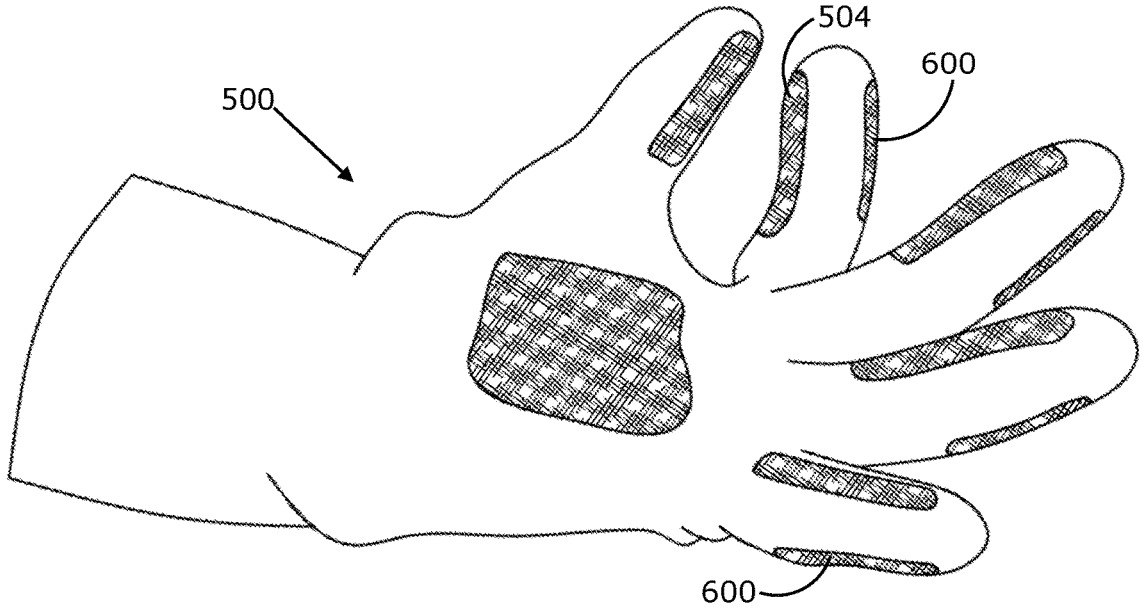
FIG. 6 illustrates a side view of the cleaning glove shown in FIG. 5, in accordance with an embodiment of the present disclosure.

Referring to FIG. 6, there is shown a side view of the cleaning glove 500 shown in FIG. 5, in accordance with an embodiment of the present disclosure. As shown, third cleaning elements 600 of the cleaning glove 500 are also implemented as steel wool pads. It will be appreciated that during cleaning of surfaces, the back section of multiple finger members (such as, the multiple finger members 110 of FIG. 1) can also be employed for cleaning.

In one example, for cleaning a baby feeding bottle using the cleaning glove 500, the second cleaning elements 504 can be employed to clean an inner surface of the feeding bottle. In such an example, while the wearer of the cleaning glove 500 is cleaning the inner surface of the cleaning bottle, the third cleaning elements 600 may also contact the inner surface of the feeding bottle at an opposite side, thereby, enabling the wearer to quickly and efficiently clean the baby feeding bottle without exerting additional effort.

Figure 7:
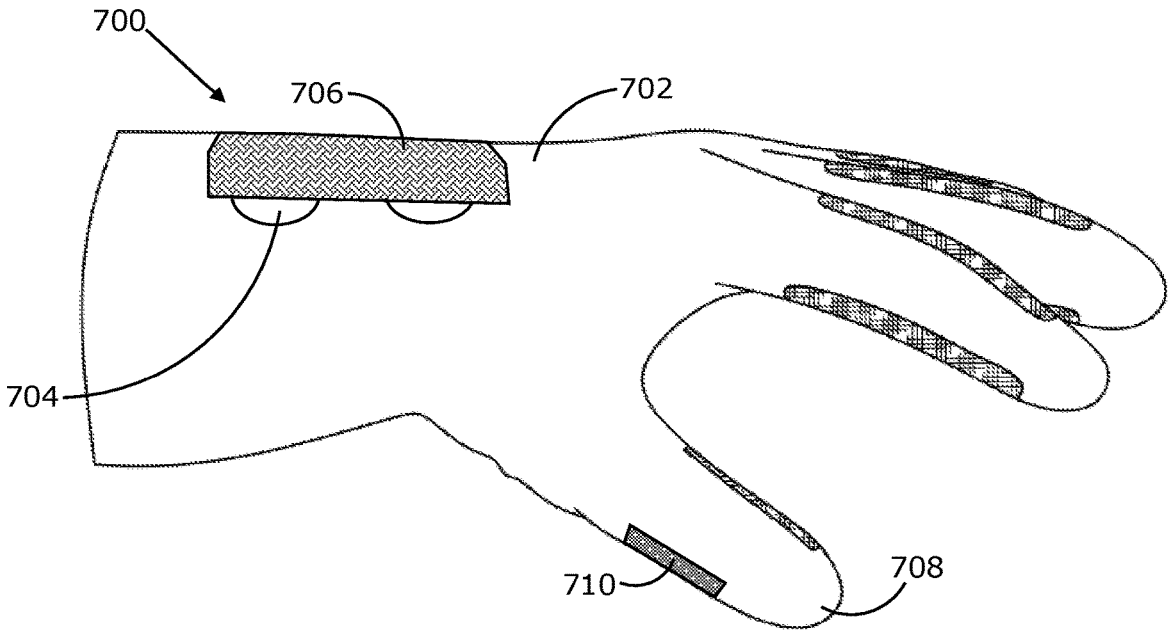
FIG. 7 illustrates a side view of a cleaning glove, in accordance with another embodiment of the present disclosure.

Referring to FIG. 7, there is shown a side view of a cleaning glove 700, in accordance with another embodiment of the present disclosure. The cleaning glove 700 is similar to the cleaning glove 500 shown in shown in FIGS. 5-6. As shown, the cleaning glove 700 comprises a back hand member 702 comprising a sixth mounting surface 704. Further, a sixth cleaning element 706, implemented as a metal sponge, is detachably coupled to the sixth mounting surface 704. Moreover, a thumb member 708 (same as 118) of the cleaning glove 700 comprises a fifth cleaning element 710, implemented as an abrasive pad, detachably coupled to the thumb member 708.

Figure 8:
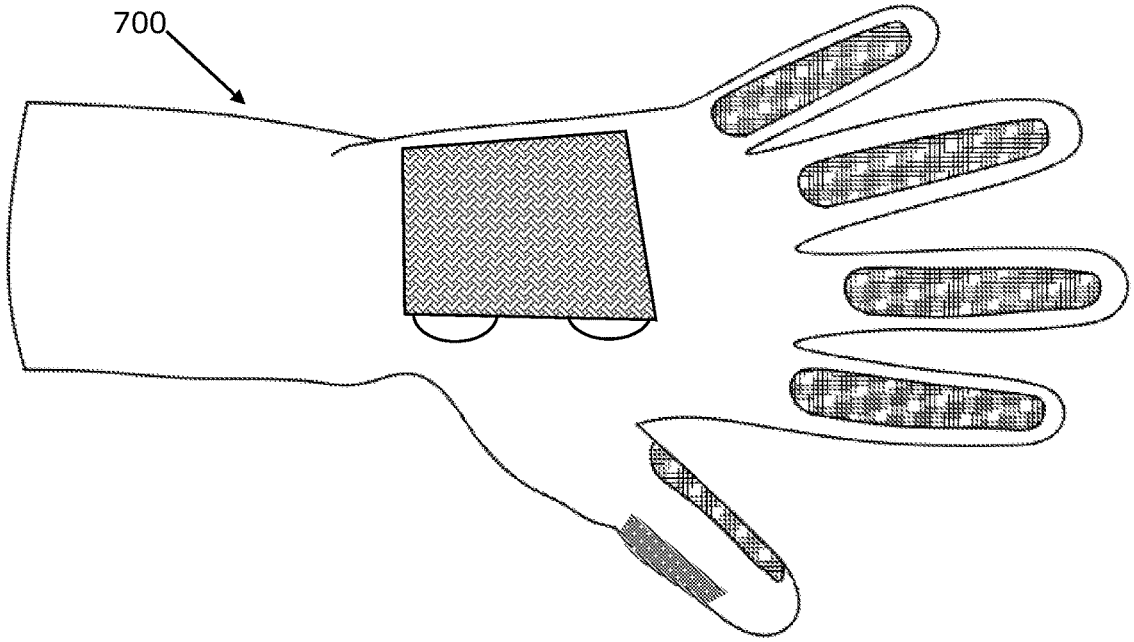
FIG. 8 illustrates a rear view of the cleaning glove shown in FIG. 7, in accordance with an embodiment of the present disclosure.

Referring to FIG. 8, there is shown a rear view of the cleaning glove 700 shown in FIG. 7, in accordance with an embodiment of the present disclosure. It will be appreciated that during usage of the cleaning glove 700 for cleaning surfaces, different surfaces may be encountered in close proximity to each other. For example, in a kitchen, lower surfaces of cabinets may be encountered in close proximity to a countertop. In such an example, the sixth cleaning element 706 enables the wearer of the cleaning glove 500 to quickly and conveniently clean both the surfaces that are in close proximity to each other. The wearer can insert their hand into a gap between the surfaces while wearing the cleaning glove 700 and as the wearer cleans the countertop using the first cleaning element and second cleaning elements of the cleaning glove (that may be implemented, for example, as abrasive pads), a lower surface of the cabinet above the countertop is simultaneously cleaned by the sixth cleaning element 706, enabling the wearer to quickly and conveniently clean both surfaces without exerting additional effort.

Figure 9:
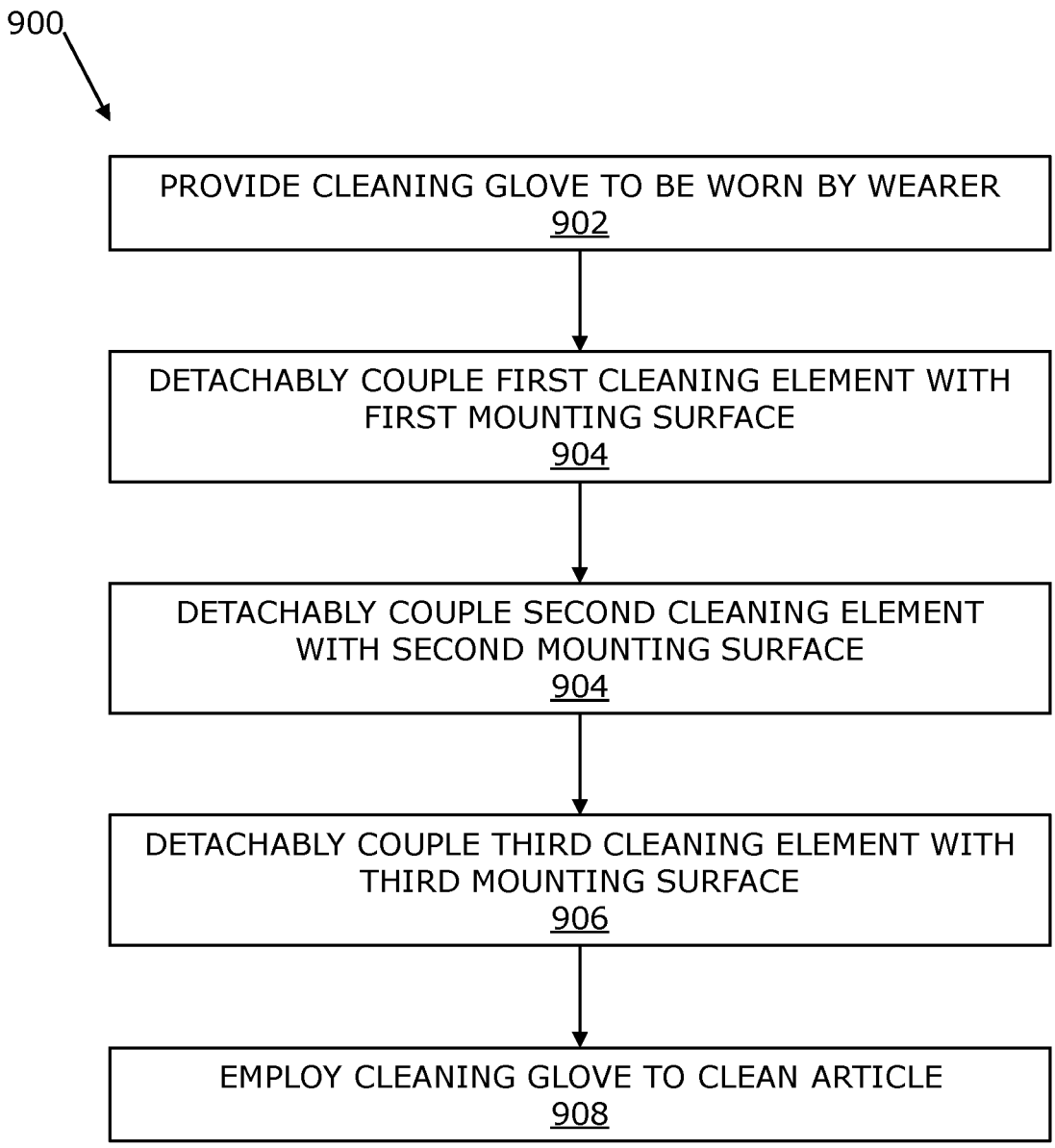
FIG. 9 illustrates a flowchart of a method for cleaning an article using the cleaning glove, in accordance with an embodiment of the present disclosure.

Referring to FIG. 9, there is shown a flowchart of a method 900 for cleaning an article using the cleaning glove 100. At a step 902, the cleaning glove 100 is provided to be worn by the wearer. At a step 904, the first cleaning element 108 is detachably coupled with the first mounting surface 106. At a step 906, the second cleaning element 116 is detachably coupled with the second mounting surface 114. At a step 908, the third cleaning element 400 is detachably coupled with the third mounting surface. At a step 910, the cleaning glove 100 is employed to clean the article.

The cleaning glove 100 enables the wearer to detachably couple various cleaning elements to the cleaning glove 100, thereby, reducing a requirement to carry and manage different cleaning equipment for cleaning different surfaces. Further, the detachable coupling of the various cleaning elements to the cleaning glove 100 enables removal thereof, such as, after any particular cleaning element has undergone substantial wear and tear, thereby, reducing costs associated with manufacturing and having to purchase new cleaning gloves. Thus, the cleaning glove 100 disclosed hereinabove enables to clean various surfaces efficiently, effectively and at low cost.

While several implementations have been described and illustrated herein, a variety of other means and/or structures for performing the function and/or obtaining the results and/or one or more of the advantages described herein may be utilized, and each of such variations and/or modifications is deemed to be within the scope of the implementations described herein. More generally, all parameters, dimensions, materials, and configurations described herein are meant to be exemplary and that the actual parameters, dimensions, materials, and/or configurations will depend upon the specific application or applications for which the teachings is/are used. Those skilled in the art will recognize or be able to ascertain using no more than routine experimentation, many equivalents to the specific implementations described herein.

| | |
|---|---|
| CLEANING GLOVE | 100, 500 |
| PALM MEMBER | 102 |
| FRONT SURFACE | 104 |
| FIRST MOUNTING SURFACE | 106 |
| FIRST CLEANING ELEMENT | 108, 502 |
| FINGER MEMBERS | 110 |
| OUTER SURFACE | 112 |
| SECOND MOUNTING SURFACE | 114 |
| SECOND CLEANING ELEMENT | 116 |
| THUMB MEMBER | 118, 708 |
| FOURTH MOUNTING SURFACE | 120 |
| FOURTH CLEANING ELEMENT | 122, 506 |
| FIRST MOUNTABLE SURFACE | 200 |
| FIRST GRIPPER | 202 |
| THIRD CLEANING ELEMENT | 400 |
| SECOND CLEANING ELEMENTS | 504 |
| THIRD CLEANING ELEMENTS | 600 |
| BACK HAND MEMBER | 702 |
| SIXTH MOUNTING SURFACE | 704 |
| SIXTH CLEANING ELEMENT | 706 |

The invention claimed is:

1. A cleaning glove comprising:

a palm member arranged to enclose the palm of a wearer, wherein the palm member comprises:

an inner surface arranged to contact the palm of the wearer when worn;

a front surface that includes a hook and loop palm mounting surface; and a palm cleaning element arranged to detachably couple with the hook and loop palm mounting surface on the palm member, wherein the palm cleaning element includes a hook and loop mountable surface arranged to mate with the hook and loop palm mounting surface on the palm member and a gripper tab to enable detachment of the palm cleaning element from the hook and loop palm mounting surface;

multiple finger members connected to the palm member, each finger member arranged to receive and enclose a finger of the wearer when worn and each finger member having a front section facing the palm and an opposed back section, wherein each finger member includes:

an inner surface of the finger member arranged to contact the received finger of the wearer when worn;

an outer surface on the front section of the each finger member that includes a hook and loop front section finger mounting surface;

a front finger cleaning element for each finger member arranged to detachably couple with the hook and loop front section finger mounting surface, wherein the front finger cleaning element includes a hook and loop mountable surface arranged to mate with the front section finger mounting surface and a gripper tab to enable detachment of the front finger cleaning element from the finger hook and loop front section mounting surface; and on the opposed back section of each finger member a hook and loop back section finger mounting surface;

a back finger cleaning element arranged to detachably couple with the hook and loop back section finger mounting surface, wherein the back finger cleaning element includes a hook and loop mountable surface arranged to mate with the back section finger mounting surface and a gripper tab to enable detachment of the back finger cleaning element from the finger hook and loop back section mounting surface.

2. The cleaning glove of claim 1, wherein the each front finger cleaning element and each back finger cleaning element is an absorbent sponge pad, a metal sponge pad, an abrasive pad, a bristle pad, or a steel wool pad.

3. The cleaning glove of claim 1 comprising:

a back hand member arranged to connect with the each of the finger members at the back section, wherein the back hand member comprises:

a frontal surface arranged to receive a back hand hook and loop mounting surface; and a back hand cleaning element arranged to detachably couple with the back hand hook and loop mounting surface, wherein the back hand cleaning element comprises a back hand hook and loop mountable surface arranged to mate with the back hand hook or loop mounting surface and a gripper tab to enable detachment of the back hand cleaning element from the back hand hook and loop mountable surface.

* * * * *